US007758945B2

(12) United States Patent
Noelle

(10) Patent No.: US 7,758,945 B2
(45) Date of Patent: Jul. 20, 2010

(54) MACHINE FOR PRODUCING A PATTERNED TEXTILE PRODUCT AND NONWOVEN PRODUCT THUS OBTAINED

(75) Inventor: Frédéric Noelle, Saint-Nazaire les Eymes (FR)

(73) Assignee: Rieter Perfojet, Montbonnot (FR)

( * ) Notice: Subject to any disclaimer, the term of this patent is extended or adjusted under 35 U.S.C. 154(b) by 974 days.

(21) Appl. No.: 10/980,964

(22) Filed: Nov. 4, 2004

(65) Prior Publication Data

US 2005/0095403 A1 May 5, 2005

Related U.S. Application Data

(62) Division of application No. 10/331,411, filed on Dec. 30, 2002, now Pat. No. 6,865,784.

(30) Foreign Application Priority Data

Jan. 15, 2002 (FR) ..... 02 00419

(51) Int. Cl.
*B32B 3/26* (2006.01)

(52) U.S. Cl. ..... 428/88; 428/156; 428/196; 442/409

(58) Field of Classification Search ..... 428/156, 428/198, 196, 88; 442/409
See application file for complete search history.

(56) References Cited

U.S. PATENT DOCUMENTS

| | | | | |
|---|---|---|---|---|
| 3,590,453 A | | 7/1971 | Bryand | |
| 3,679,535 A | | 7/1972 | Kalwaites | |
| 3,681,184 A | | 8/1972 | Kalwaites | |
| 3,750,237 A | | 8/1973 | Kalwaites | |
| 3,781,957 A | | 1/1974 | Luthi | |
| 3,800,364 A | | 4/1974 | Kalwaites | |
| 3,828,410 A | | 8/1974 | Zeiffer | |
| 4,050,131 A | | 9/1977 | Bryand | |
| 4,414,597 A | * | 11/1983 | Cornin | 360/133 |
| RE31,825 E | * | 2/1985 | Mason et al. | |
| 4,774,110 A | * | 9/1988 | Murakami et al. | 427/365 |
| 4,868,958 A | | 9/1989 | Suzuki | |
| 5,026,587 A | * | 6/1991 | Austin et al. | 428/91 |

(Continued)

FOREIGN PATENT DOCUMENTS

| | | |
|---|---|---|
| FR | 2 799 214 | 4/2001 |

OTHER PUBLICATIONS

U.S. Appl. No. 11/913,115, filed Oct. 31, 2007, Inventor: Ludovic Leroy, Assignee: Rieter Perfojet.

*Primary Examiner*—Elizabeth M Cole
(74) *Attorney, Agent, or Firm*—Pearne & Gordon LLP

(57) ABSTRACT

Machine for producing a patterned textile product, comprising a drum with a perforated lateral surface rotated about its axis, a sleeve with holes which is slipped over the drum, and having a ration of the sum of the surface area of the holes to the surface area of its total lateral surface of between 5 and 75% and, preferably, between 7 and 50% and a hole diameter not greater than 1 mm, a device for spraying water jets in the direction of the drum in a direction substantially radial thereto and means for creating a vacuum inside the drum wherein an apertured sheath is slipped over the sleeve and has apertures at least one dimension of which is greater than 2 mm.

16 Claims, 3 Drawing Sheets

U.S. PATENT DOCUMENTS

Figure 1:
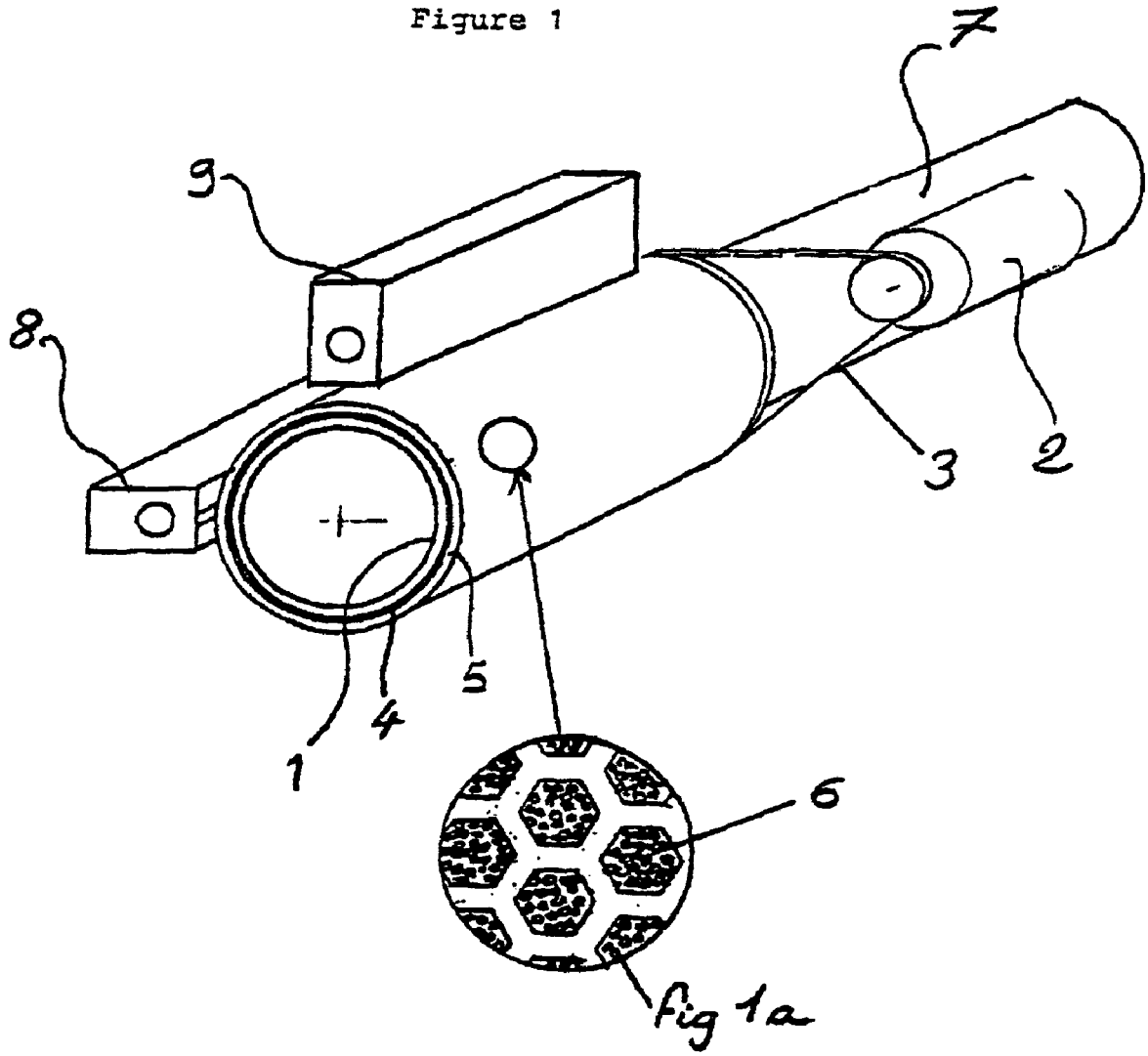

| | | | |
|---|---|---|---|
| 5,768,756 | A | 6/1998 | Noelle |
| 6,055,710 | A | 5/2000 | Fleissner |
| 6,324,738 | B1 | 12/2001 | Fleissner |
| 6,338,187 | B1 | 1/2002 | Fleissner |
| 6,708,381 | B2 | 3/2004 | Strandqvist et al. |
| 6,751,830 | B2 | 6/2004 | Sternlieb et al. |
| 2002/0034914 | A1 | 3/2002 | De Leon et al. |
| 2002/0160681 | A1 | 10/2002 | Noelle |

* cited by examiner

Water
Water
Water

MACHINE FOR PRODUCING A PATTERNED TEXTILE PRODUCT AND NONWOVEN PRODUCT THUS OBTAINED

This application is a division of application Ser. No. 10/331,411, filed Dec. 30, 2002, now U.S. Pat. No. 6,865,784.

The present invention relates to machines for producing patterned woven, knitted and nonwoven textile products and to the nonwovens produced by these machines.

Documents U.S. Pat. Nos. 6,055,710 and 5,768,756 describe machines for producing nonwovens in which a drum whose outermost surface consists of a microperforated sleeve is used. These machines do not allow patterned nonwovens to be obtained.

Document FR-2 799 214 describes a machine for producing a nonwoven which comprises a drum with a perforated lateral surface. The drum is rotated about its axis. The machine comprises a sleeve with holes which is slipped over the drum. In practice, the sleeve has a ratio of the sum of the surface areas of the holes to the surface area of its total lateral surface which is between 5 and 75% and a hole diameter which is not greater than 1 mm. A water-jet spray device sprays water jets in the direction of the drum in a direction substantially radial thereto and means for creating a vacuum inside the drum are provided, which make it possible to remove air and water therefrom.

This machine makes it possible to obtain patterned nonwovens. However, these nonwovens are very fluffy and lose the substantially flat appearance that is sought.

The invention overcomes this drawback by means of a machine which makes it possible to obtain patterned products, whose fluffiness is low and is not obvious and which conserves a substantially flat appearance of the patterns. These machines can also be used to produce patterned woven or knitted products made from natural, synthetic or artificial fibres.

According to the invention, an apertured sheath is slipped over the sleeve and has apertures at least one dimension of which is greater than 2 mm.

Surprisingly, this makes it possible to virtually remove the fluffiness from the patterned nonwoven and renders the surface of its patterns substantially flat.

Preferably, at least one dimension of the apertures is greater than 2 mm or, better still, greater than 10 mm and, preferably, at least two mutually perpendicular dimensions of the apertures are greater than 2 mm.

Good results were obtained when the sheath has a thickness of between 0.1 and 2.5 mm and, preferably, between 0.3 and 1.0 mm.

It is preferred that the ratio of the surface area of the apertures to the total lateral surface area of the sheath be between 10 and 70%.

Preferably, the apertures of the sheath are separated by bridges of microperforated material with holes having diameters of between 50 and 500 microns. Water drainage is thus facilitated, which is useful especially when the bridges have one dimension, especially a width, greater than 3 mm, so that faults and marks are not created on the nonwoven.

The distribution of holes in the sleeve may be random. The holes may also be ordered, by being aligned or in staggered rows. The sleeve may consist of a metal fabric or be made of a synthetic material or made of a mixture of metal fabric and of synthetic material. It is preferred that the hole diameter be between 200 and 800 microns.

The sleeve may especially be a metal fabric or a synthetic fabric.

The closed rotating drum may have a stationary body and a rotating lateral surface made of perforated sheet metal or in the form of a honeycomb, which makes it possible to increase the pressure of the jets and the production rate with improved bonding. The drum may be a Sandusky bronze cylinder having helical holes. It may also be a tube made of rolled perforated sheet metal coated with a drainage sleeve made of a coarse metal fabric which provides good uniformity of water extraction.

Finally, the invention aims for a nonwoven product which comprises entangled filiform elements and in which patterned parts are embossed. According to the invention, the free ends of the filiform filaments project from the patterned parts by a distance of less than 2 mm and, preferably, less than 1.5 and the number of free ends which thus project is less than 10, preferably less than 5 and, better still, less than 3/5 $mm^2$. It is possible to determine the said distance and the said number as follows: they are observed using a magnifying glass having a magnification of 8.

The upper face of the projecting parts is substantially flat, unlike the patterned nonwovens of the prior art in which these parts were clearly curved, apart from the fact that they were very fluffy. The flatness can be measured as follows: the nonwoven is tested with an apparatus for measuring the thickness of nonwovens as recommended by the EDANA ERT 30.5-99 standard. The curved faces of the projecting parts are placed facing the moveable foot of the apparatus. When the moveable foot comes into contact with the curved part, the first thickness value is recorded. When the moveable foot continues its descent and arrives at the lowest part of the surface of the curved part, a second thickness value is read on the apparatus. The difference between these two values corresponds to the flatness of the relief parts. The smaller this difference, the better the flatness. According to the invention, the flatness of the projecting parts is between 0.1 and 1.5 mm and, preferably, less than 1 mm.

Good results are obtained when the projecting parts each have at least one dimension greater than 2 mm and, preferably, have two mutually perpendicular dimensions greater than 2.5 mm and when the gaps between two neighbouring projecting parts is between 0.5 and 10, the projecting parts may be circular, oval or polygonal, but also have any shape in the form of a logo.

The nonwovens may consist of natural or artificial or synthetic fibres. The nonwovens are generally obtained by what is referred to as the carding or aerodynamic technique; they may also consist of continuous thermoplastic filaments obtained by the spunbond or even the meltblown technique. The nonwovens may also be obtained by what is referred to as the wet technique; they may also be obtained by the combination of several methods such as for example spunbond+carded web, spunbond+natural fibres bonded by the "airlaid" aerodynamic technique. Good results were obtained with 30 to 150 $g/m^2$ nonwovens based on viscose, viscose/polyester blends and cotton. However, this list is not limiting. The thicknesses of the nonwovens, including the projecting patterns, are generally between 0.5 mm and 2.5 mm and the additional height of the projecting parts is between 0.3 and 2.0. The thickness and the additional height are measured as follows: the thickness is measured by placing the nonwoven in an apparatus for measuring the thickness of nonwovens as recommended by the EDANA ERT 30.5-99 standard. The additional height is measured with a magnifying glass of magnification 8 and with micrometric graduations.

Generally, the nonwoven has undergone a first bonding treatment on a standard machine for bonding nonwovens by means of water jets and immediately after is transferred continuously to the device forming the subject of the invention. This prior treatment is not to be carried out for woven and knitted products.

To carry out the treatment aiming to produce the patterns, the jets have a diameter of between 80 and 170 microns and, preferably, between 100 and 140 microns. The number of jets per metre is between 1 000 and 5 000 and, preferably, between 1 500 and 4 000. The water pressure in the injectors is between 10 and 400 bar and, preferably, between 80 and 250 bar. In general, the vacuum in the drum is between −20 mbar (millibar) and −200 mbar and the drum is driven at a speed of between 1 and 400 m/min.

Figures 2, 2A, 2B, 2C:
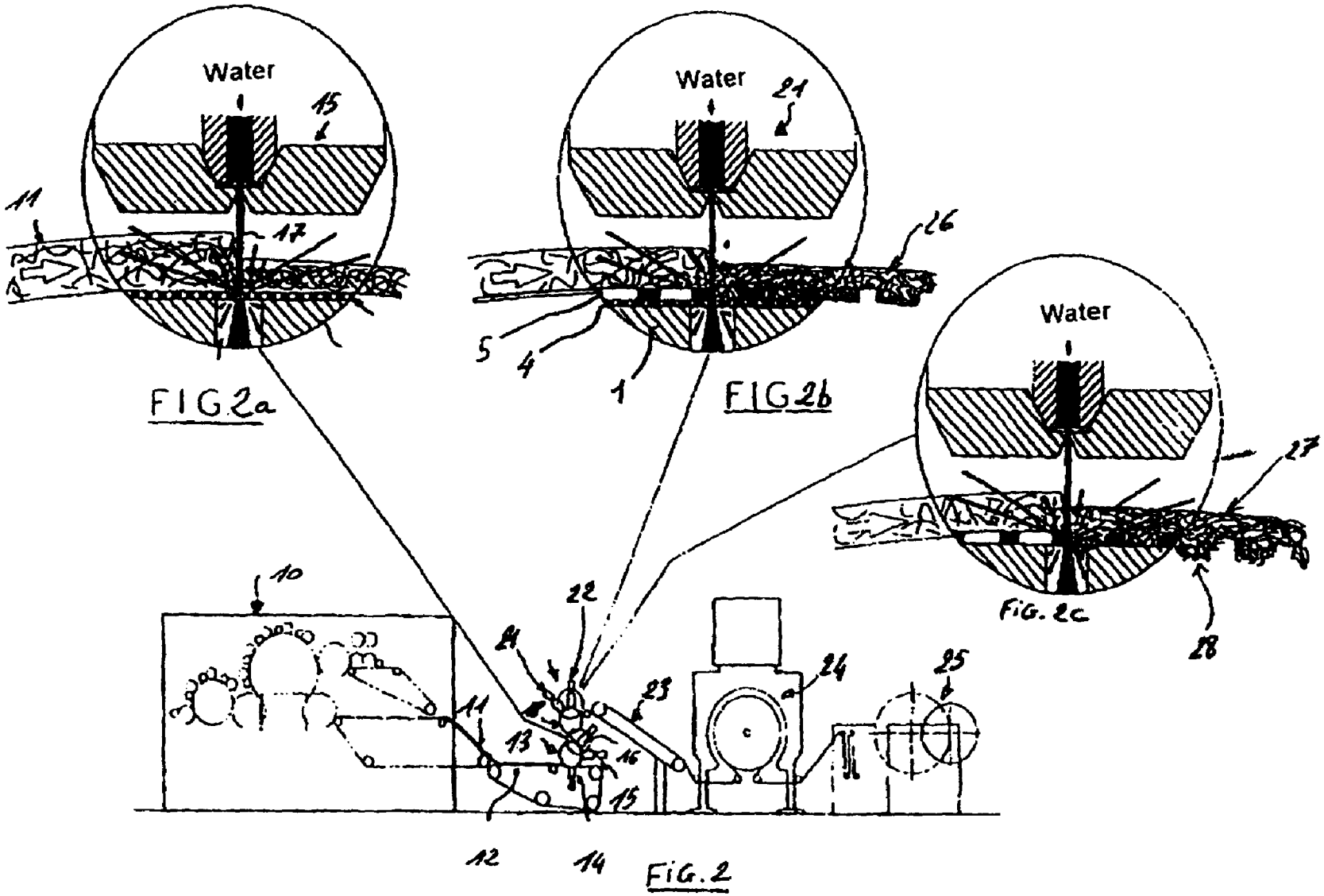
Figure 3:
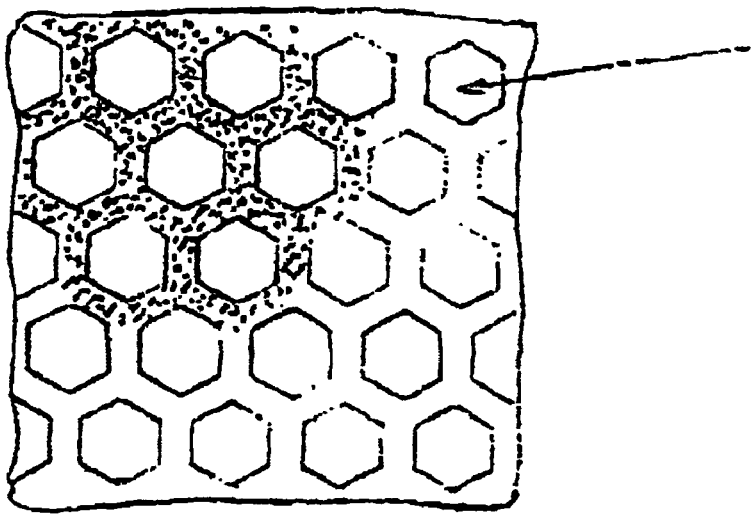
Figure 4:
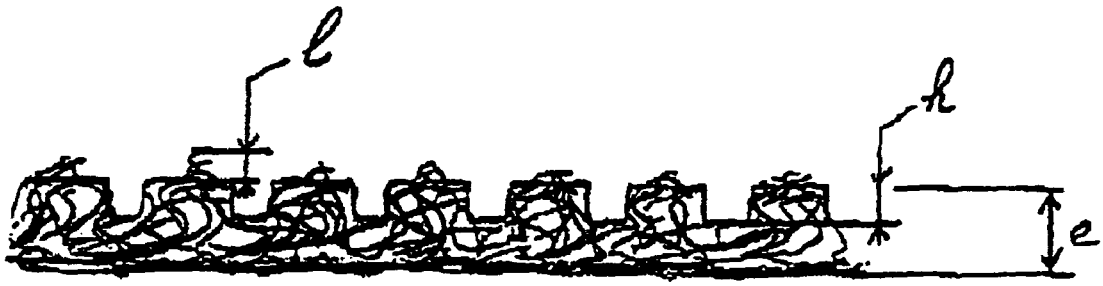

With respect to the appended drawings, given solely by way of example:

FIG. 1 is a perspective view with cutaway of a machine according to the invention, FIG. 1*a* is a view on a larger scale of part of the apertured sheath of the machine, FIG. 2 is a schematic view of a plant incorporating the machine according to the invention, FIGS. 2*a* and 2*b* are views on a larger scale of two parts of the plant of FIG. 2, FIG. 2*c* is a view corresponding to FIG. 2*b* of a machine of the prior art, FIG. 3 is a schematic plan view of a nonwoven according to the invention, and FIG. 4 is a schematic plan view corresponding to FIG. 3.

The machine shown schematically in FIG. 1 comprises an inner drum 1 consisting of a stationary body and of sheet metal forming the lateral surface. The lateral surface is rotated by a device 2 with a belt drive 3. The lateral surface is perforated with perforations having a diameter of 10 mm. The ratio (void content) of the sum of the surface areas of the perforations to the total surface area of the lateral surface is 70%. This drum 1 is surrounded by a sleeve 4 slipped over the drum. The sleeve has holes. The ratio of the sum of the surface areas of the holes to the surface area of the total lateral surface is 10%. The holes have a diameter of 0.30 mm.

The sleeve 4 is surrounded in its turn with an apertured sheath 5 which can be seen better in FIG. 1*a*. The apertures 6 are of hexagonal shape, their largest dimension is 10 mm. The inside of the drum 1 communicates with a pipe 7 for extracting air and water. Two injectors 8 and 9 respectively send water jets in the direction of the sheath 5.

The sheath 5 is made of stainless steel, brass or nickel, or even of plastic. The apertures 6 are cut by what is known as the punching technique or else by laser cutting or else by water jet cutting. It is also possible to obtain the apertures 6 by what is known as the nickel electrodeposition technique commonly employed for the manufacture of screen-printing cylinders. It is also possible to use plastics or elastomers cut by laser or other techniques. The sheath has a thickness of between 0.1 and 2 mm and, preferably, between 0.3 and 1 mm.

The drum 1 has a void content of between 5 and 75% and, preferably, between 10 and 50%. The drum 1 has a diameter of about 520 mm.

The sleeve 4 is, preferably, made of nickel and is obtained by nickel electrodeposition. It is microperforated with holes having a diameter ranging from 50 to 500 microns and, preferably, between 200 and 400 microns. It has a thickness of between 0.1 and 0.6 mm and, preferably, between 0.2 and 0.4 mm.

In FIG. 3, the projecting patterns are columnar in the form of hexagonal projections. The apertures are delimited by solid parts or bridges of material. These bridges are perforated with holes having a diameter of between 100 and 300 microns. In FIG. 4, e denotes the total thickness of the nonwoven, h the additional height of the patterns and l the length of the hairs, measured perpendicularly to the nonwoven.

The following examples illustrate the invention.

EXAMPLE 1

FIGS. 2, 2*a* and 2*b*

A product according to the invention was produced as follows. A web of about 65 g/m$^2$ consisting of 100% 40 mm 1.7 dtex viscose fibres was produced at a speed of 60 m/min by a carding machine of the type for nonwovens. This web was transported by a conveyor belt over a hydraulic bonding unit of the type marketed under the name "Jetlace 3000", adapted for implementing the method according to the invention. The web was compacted between the conveyor belt and a first bonding cylinder coated with a microperforated jacket, the holes being placed randomly, as described in French Patent No. 2 734 285. During compacting, the web was wetted by the injector located behind the conveyor belt, just after the compacting point, an injector which was placed perpendicular to the generatrix of the cylinder. This injector was equipped with a plate perforated with 140 micron holes separated from each other by a distance of 1 mm and operating at a pressure of 15 bar. The lightly prebonded web compacted and wetted in this way was then subjected to the action of two successive hydraulic injector springing water jets of 120 microns diameter at increasing speeds of 100 and 125 m/second. The water jets were spaced 0.6 mm apart from each other. After bonding treatment, the bonded web underwent a treatment according to the invention by being made to pass over the rotating drum 1 having the sleeve 4 and the sheath 5: the sheath 5 had 12 mm hexagonal apertures and a thickness of 0.8 mm and a void content (ratio of the sum of the surface areas of the apertures to the total surface area of the lateral surface) of 50%. It was tailored to the microperforated sleeve 4 whose holes had a diameter of 300 microns and a hole density of 100 holes per square centimeter. This microperforated sleeve had a thickness of 0.35 mm. The fibrous web, previously consolidated on the above cylinder, was subjected to the action of two successive injectors delivering jets having a diameter of 120 microns at a speed of 150 m/second, the jets being spaced 0.6 mm apart from each other. The perforations of the drum had a diameter of 10 mm. The ratio of the sum of the surface areas of the perforations to the total surface area of the lateral surface was 70%. The web was then transferred to a suction belt connected to a vacuum generator, then dried at a temperature of 150° C. in an oven with air passing through, then wound in the form of a reel. A nonwoven weighing about 60 g/m$^2$ was obtained, it had a hexagonal pattern with high definition of the hexagonal pattern and whose projecting parts (patterns) were columnar and free from fluffiness or from fibres standing on end, as shown in FIGS. 3 and 4. The gap between two neighbouring patterns was 3 mm. The nonwoven had a thickness of 0.7 mm and the patterns had an additional thickness of 0.5 mm. Observation by means of the magnifying glass of five patterns taken at random showed that the number of hairs per 5 mm$^2$ was less than 4 in each pattern and that the length of the few hairs that appeared, measured on the upper face of the pattern, was less than 1.5 mm.

EXAMPLE 2

The treatment conditions were the same as those given in Example 1. A product consisting of a 70/30 blend of viscose and polyester fibres was produced. The fibres had a linear density of 1.7 dtex and a length of 40 mm. At the output of the carding machine, the web formed weighed about 65 g/m$^2$ and, after treatment, about 60 g/m$^2$. It had a high-definition hexagonal pattern whose relief parts were free from fluffiness as in Example 1.

COMPARATIVE EXAMPLE

FIG. 2*c*

The same examples were produced as above, but the second rotating drum was altered by removing the microperforated sleeve placed inside the apertured sheath. The products thus obtained had a poor-definition pattern whose projecting parts had high fluffiness and many fibres standing on end in the case of the viscose nonwoven and in the case of the viscose/polyester blend. Many fibres (15/5 mm$^2$) were raised from the surface of the projecting parts and, in addition, these fibres were easily removed from the surface and some had a length of 10 mm.

EXAMPLE 3

"Textile Product"

A 100 g/m$^2$ cotton fabric was subjected to treatment on a unit according to the invention and identical to that of Examples 1 and 2. At a speed of 5 m/minute, it was subjected to the action of two successive injectors delivering jets having a diameter of 120 microns at a speed of 243 m/second, the jets being spaced 0.6 mm apart from each other. The fabric was then dried in an oven with air passing through at a temperature of 100° C. The fabric had a hexagonal relief pattern free from fluffiness.

We claim:

1. A nonwoven which comprises entangled filiform elements with free ends and in which patterned projecting parts are embossed, wherein the free ends of the filiform elements project from the patterned parts over a length of less than 1 mm and the number of these ends is less than 10/5 mm$^2$, the patterned parts are columnar and have flat upper faces produced as a result of being embossed against a restraining surface, and the filiform elements project from the upper faces of the patterned parts.

2. The nonwoven according to claim 1, wherein each projecting part has at least one dimension greater than 2 mm.

3. The nonwoven according to claim 1, wherein the nonwoven has a substantially flat upper surface between the patterned projecting parts and the projecting parts have an additional height which is between 0.3 and 2.00 mm extending above the flat upper surface of the nonwoven.

4. The nonwoven according to claim 1, wherein the thickness of the nonwoven, including the projecting parts, is between 0.5 and 2.5 mm.

5. The nonwoven according to claim 1, wherein the patterned parts have columnar shapes.

6. The nonwoven according to claim 1, wherein the patterned parts are embossed by fluid passing through the nonwoven and the patterned parts have a columnar shape resulting from the fluid passing through the patterned parts.

7. The nonwoven according to claim 6, wherein the fluid is water.

8. A nonwoven which comprises entangled filiform elements with free ends and in which patterned projecting parts are embossed, wherein the patterned part has a columnar shape, extending to an upper face resulting from being shaped against a restraining surface and from fluid passing through the nonwoven and the restraining surface, the free ends of the filiform elements project from the upper faces of the patterned parts, and the free ends of the filiform elements project from the patterned parts over a length of less than 1 mm and the number of these ends is one or more and less than 10/5 mm$^2$.

9. The nonwoven according to claim 8, wherein the upper face is substantially flat except for the projecting free ends of the filiform elements.

10. The nonwoven according to claim 1, wherein the nonwoven has a substantially flat upper surface between the patterned projecting parts.

11. The nonwoven according to claim 8, wherein the nonwoven has a substantially flat upper surface between the patterned projecting parts.

12. A nonwoven comprising entangled filiform elements having free ends, the nonwoven includes an upper surface intermediate embossed patterned projecting parts that extend from the upper surface, the patterned projecting parts have flat upper faces except for projecting free ends of the filiform elements, and the projecting free ends of the filiform elements extend from the flat upper faces of the patterned parts over a length of less than 1 mm and the number of free ends projecting from the flat faces is less than 10/5 mm$^2$.

13. The nonwoven of claim 12, wherein the flat upper faces of the patterned projecting parts result from being shaped in contact with restraining surfaces.

14. The nonwoven of claim 13, wherein the patterned projecting parts have columnar shapes.

15. The nonwoven of claim 14, wherein the thickness of the nonwoven, including the projecting parts, is between 0.5 and 2.5 mm.

16. The nonwoven of claim 15, wherein the upper surface of the nonwoven is substantially flat between the patterned projecting parts and the projecting parts extend from the flat upper surface between 0.3 and 2.00 mm above the flat upper surface of the nonwoven.

* * * * *